US005123475A

United States Patent [19]

Klotz et al.

[11] Patent Number: 5,123,475

[45] Date of Patent: Jun. 23, 1992

[54] DRAPE CONSTRUCTION

[76] Inventors: Robert E. Klotz, 23385 Caminito Andreta, Laguna Hills, Calif. 92653; Martha M. Oliver, 29781 Yellow Gold Dr., Canyon Lake, Calif. 92380

[21] Appl. No.: 696,744

[22] Filed: May 7, 1991

[51] Int. Cl.[5] ..... A47H 13/14

[52] U.S. Cl. ..... 160/348; 160/345

[58] Field of Search ..... 160/348, 341, 344, 345, 160/330, 405, 123, 126

[56] References Cited

U.S. PATENT DOCUMENTS

| | | | |
|---|---|---|---|
| 1,860,110 | 5/1932 | Martens | 160/344 |
| 2,874,772 | 2/1959 | Dwyer et al. | 160/348 |
| 2,884,053 | 4/1959 | Truesdale | 160/330 |
| 3,084,738 | 4/1963 | Truesdale | 160/330 |
| 3,157,907 | 11/1964 | Stall | 160/345 X |
| 3,279,530 | 10/1966 | Romano et al. | 160/348 |
| 3,399,713 | 9/1968 | Wilson | 160/348 |
| 4,165,779 | 8/1979 | Jacobs | 160/348 |
| 4,226,276 | 10/1980 | Bressler | 160/348 |
| 4,655,272 | 4/1987 | Reilly et al. | 160/348 |

*Primary Examiner*—David M. Purol

*Attorney, Agent, or Firm*—Richard C. Litman

[57] ABSTRACT

Disclosed is a shirr-pleated drape and the method of manufacturing the drape. An elongated stiffened fabric strip, preferably crinoline which may be precut to size, is formed with evenly-spaced drapery hook pockets. The drape is provided with a longitudinal rod pocket along the top of a size to accommodate said fabric strip. The drape is gathered on said fabric strip and then attached to said fabric strip at said drapery hook pockets and at the ends of said rod pocket to retain said gathered drape on said fabric strip. When mounted on a rod such as a traverse rod, said drape has the appearance of being shirred when closed, and of being shirred and pleated when open.

8 Claims, 4 Drawing Sheets

FIG. 1
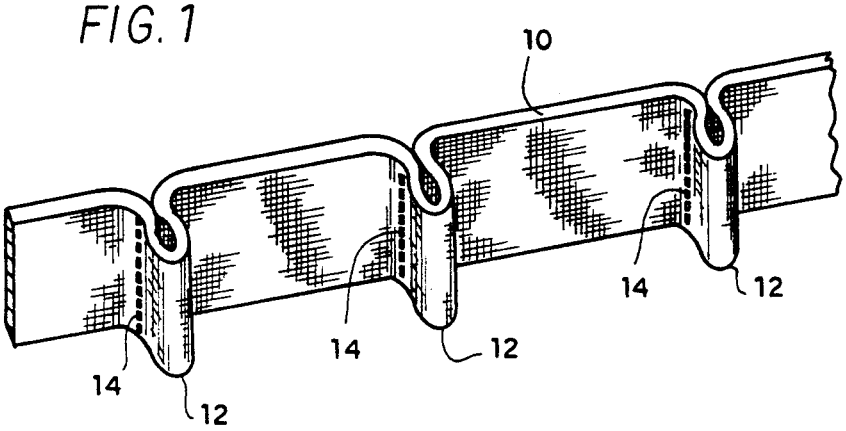
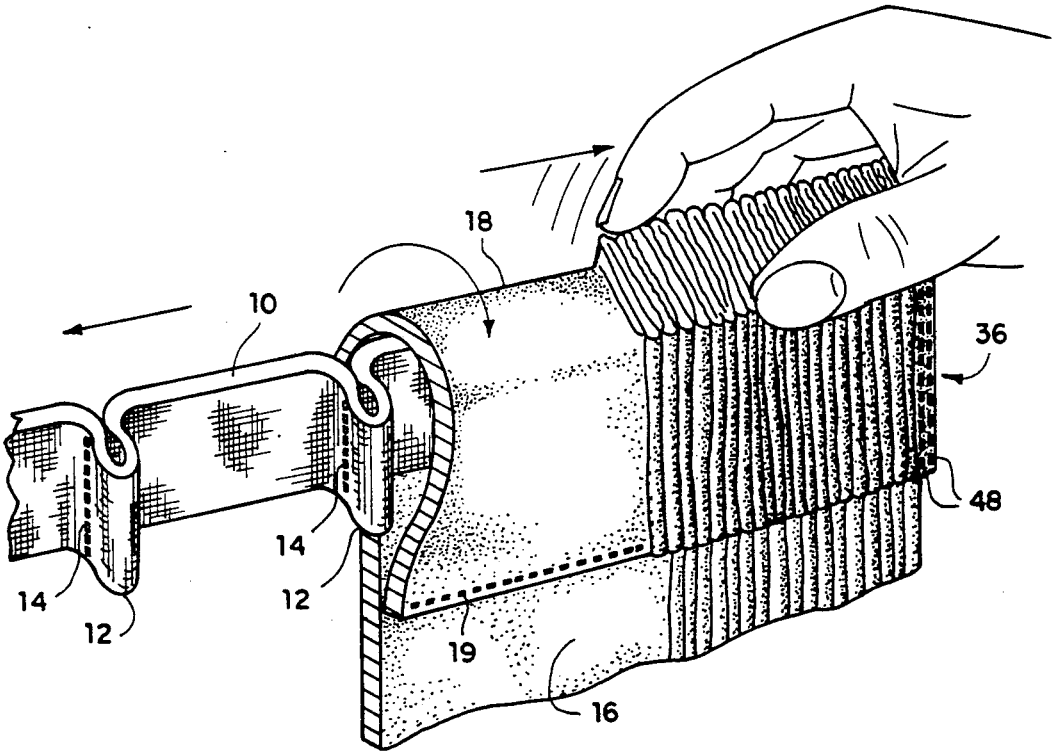
FIG. 2

DRAPE CONSTRUCTION

BACKGROUND OF THE INVENTION

This invention relates to window drape construction having the appearance of being shirred onto a straight rod when closed, but when drawn open on any traversable rod, will also stack in the same manner as and with the appearance of a pinch-pleated drape. These pleats are not permanent. As soon as the drape is closed, the drape returns to its shirred-only appearance.

Pleated drapes are well known and have been formed in a variety of ways. When pleats are formed by hand or by automatic machinery, they are sewn directly into the drapery material in permanent fashion. Pleats also may be formed by inserting various forms of specially designed hooks into the drape, where hook openings are designed and spaced far enough apart so that the insertion process will gather the material together into pleats. Finally, various forms of specially designed pleater tape and string, secured to the top of the drapes, can automate the pleating process.

PRIOR ART

U.S. Pat. No. 3,062,281 issued Nov. 6, 1962 to Bert P. Solomon discloses an example of specially designed resilient wire pleating hooks which must be inserted into the pockets of specially designed pleater tape which is stitched to the top hem of the drapery to be pleated. The insertion of these hooks will gather the drape together into permanent pleats in any desired contour. Each hook is a series of four upright longitudinally spaced and aligned pleating fingers, designed to be individually inserted into individually narrowly and longitudinally spaced vertical pockets in the fabric tape.

U.S. Pat. No. 3,279,530 issued Oct. 18, 1966 to Ralph Romano and Samuel Saewitz discloses an example using a specially designed looped fabric strip and pleater tape. Evenly-spaced loops are sewn into an elongated fabric strip at predetermined points. The strip is secured to the back of the drape. Pleater tape is threaded through loops in the fabric strip and secured to the fabric strip and drape. The tape is then pulled, bunching the fabric strip and drape about the loops and forming a series of permanent pleats.

U.S. Pat. No. 4,269,880 issued May 26, 1981 to Debra A. Nalepka discloses hook-based disposable self-pleating drapes and manufacturing method. An integral pleating strip extends along an upper marginal portion of a plastic sheet, where all attachments are performed with a heat-sealing process. A continuous-form assembly of series-connected disposable self-pleating drapes is made by continuously advancing an elongated web of disposable material, folding a longitudinally extending marginal portion of the advancing web in overlying relation with another portion of the web, and connecting the marginal portion in face-to-face relation with the other portion of the web at a longitudinal series of pleating locations to form at least two prong-receiving pockets at each pleating location. The prong-receiving openings are spaced apart a distance greater than the distance between corresponding parallel prongs on an associated drapery hook, so that when the hook is inserted into the prong-receiving openings a pleat is automatically formed in the drape.

U.S. Pat. No. 4,655,272 issued Apr. 7, 1987 to Legizia Reilly and Rita Acerra discloses an automatic pull-string-based drapery pleating device and its manufacturing method. An elongated strip of stiff material is formed by a series of transverse folds across a strip of drapery material. At least two adjacent panels between folds turn inwardly to form pleats between spaced 'control panels'. Each 'control panel' has at least two parallel-string encasement means aligned with encasement means on other 'control panels'. A 'control string' through the 'control panels' draws all of the 'control panels' into close proximity with adjacent 'control panels' located in the same plane. Between adjacent 'control panels', 'pleat panels' are folded inwardly to form pleats. All of the pleats are formed automatically and simultaneously, but the pleats must then be sewn permanently onto the 'control panels'. The top of the drapery material is then folded over the strip and sewn together to form a sleeve over the strip. Each panel may now be sewn to the drapery material.

None of the above-identified patents disclose shirred drapes. However, Belgian Patent No. 675,250 issued to Jean A. P. Gonon discloses a method and structure for forming alternately-shirred and permanently-pleated drapes by mounting a specially-designed tape at the top of the drapery material. This tape is formed of non-elastic portions and elastic portions alternately and serially connected together in a longitudinal direction. The non-elastic portions are provided with spaced pockets for conventional drapery hooks. The tape is stretched and then attached to the drapery material near the top thereof. When the tape is released, the drapery material shows a shirred effect between the non-elastic portions. By inserting a two-pronged drapery hook into adjacent pockets on the non-elastic portions of the tape, permanent pleats are formed between the shirred portions of the drape. The shirring effect is not continuous across the width of the drape.

SUMMARY AND OBJECTS OF THE INVENTION

It is an object of this invention to provide drapes that have a shirred appearance when closed which is continuous across the width of the drapes, and a shirred and pleated appearance when the drapes are open.

It is another object of this invention to provide a method of manufacturing drapes which have the appearance of being shirred continuously across the width of the drape when closed and the appearance of being shirred and pleated when open.

It is still another object of this invention to provide shirred, pleated drapes which are economical to manufacture and pleasing to the eye in both the open and closed positions, without the necessity of an excessive amount of sewing.

The foregoing objects are achieved by the economically manufactured drapery of this invention. Manufacturing economy starts with the use of only readily available conventional materials, including coarse stiffened material strips such as crinoline, standard drapery hooks, and tranversing rods such as a traverse rod or deco' rod, and drapery fabric. Economy is maintained with the elimination of the need for two standard drapery machines: the pleating machine and the bar tack. Only three standard machines need be used: the overlock, the hemmer, and the straight-stitch. The process uses far less labor and machine time than conventionally pleated drapery manufacturing methods.

The manufacturing process involves the following steps. First, evenly-spaced drapery hook pockets are sewn into any coarse, stiffened fabric such as crinoline. The crinoline or coarse fabric strip is pre-measured for exact drapery size prior to making the drapery, thus eliminating any waste of the crinoline and, in turn, increasing cost-efficiency. Next, the top of the drape is folded and pressed over onto itself to form a rod pocket about one-half inch wider than the coarse fabric strip. The coarse fabric strip is placed into the folded rod pocket as if the coarse fabric strip was a straight rod. The rod pocket is then stitched to the coarse fabric strip at one end and along the bottom edge of the rod pocket to close the pocket. The coarse fabric strip and the drape are pulled in opposite directions to shirr the drape over the coarse fabric strip while simultaneously sewing the rod pocket. The opposite end of the rod pocket is stitched to the coarse fabric strip, securing the shirred effect. After ensuring that the gathering of the drape is evenly distributed along the length of the coarse fabric strip the drape is sewn or stitched onto the drapery hook pockets on the back side of the drape. Subsequently, as the drapes are hung, standard drapery hooks are inserted through the back of the drapes into drapery hook pockets, and the tops of the drapes are manually vertically creased halfway between each drapery hook pocket to form temporary pleats.

Because of the pleating capability represented by the drapery hook pockets and the creased coarse stiffened fabric, the drape has the appearance of being pleated only when open. The drape opens (stacks back) evenly, giving the look of shirred and pleated drapery. As a result of the gathered (shirred) design, the drape always will have the appearance of being shirred. When the drapes are closed, they appear to be continuously shirred across the width thereof without pleats.

Other objects, features and advantages of this invention will be apparent from the following detailed description and the appended claims, reference being had to the accompanying drawings forming a part of the specification, wherein like reference numerals designate corresponding parts of the several views.

BRIEF DESCRIPTION OF THE DRAWINGS

FIG. 1 is a partial perspective view of a coarse fabric strip having drapery hook pockets sewn therein at even intervals.

FIG. 2 is a partial perspective rear view showing a drape, having a pocket sewn at the top of the drape, being gathered on the coarse fabric strip of FIG. 1 to create a shirred effect.

DETAILED DESCRIPTION OF THE PREFERRED EMBODIMENT AND METHOD

Figure 3:
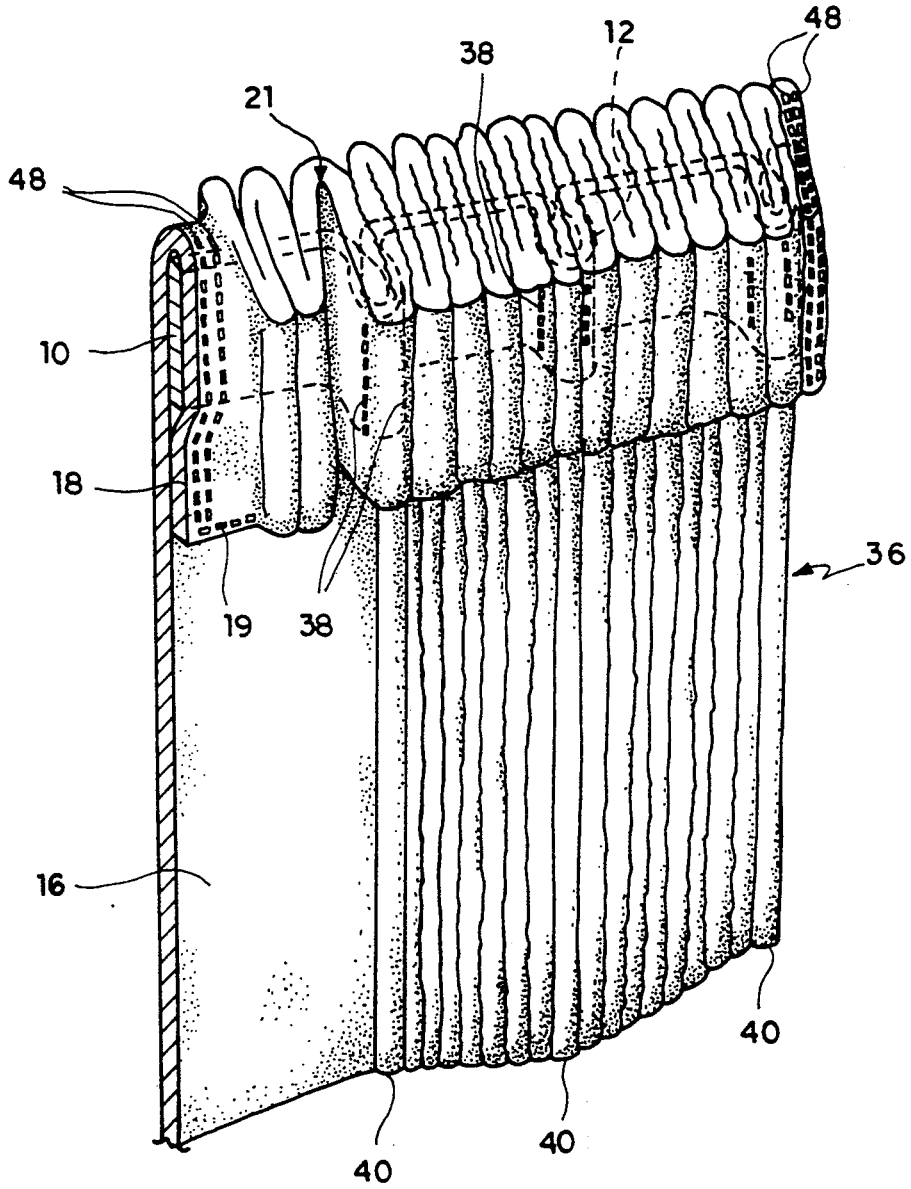
FIG. 3 is a partial perspective rear view similar to FIG. 2, showing portions of the gathered drape stitched to the drapery hook pockets and the ends of the fabric strip of FIG. 1.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein are for the purpose of description, and not limitation.

In FIG. 1, there is shown a strip of pre-cut stiffened fabric 10 such as crinoline. Drapery hook pockets 12 are pre-sewn into the fabric strip 10 as indicated by the stitching 14. Pockets 12 are about 4 inches apart across the width of drape 16, and about 2 inches apart at the "drapery return" located at the ends of drape 16, perpendicular to the wall. Each drapery hook pocket is about ⅜th-inch deep.

Figure 4:
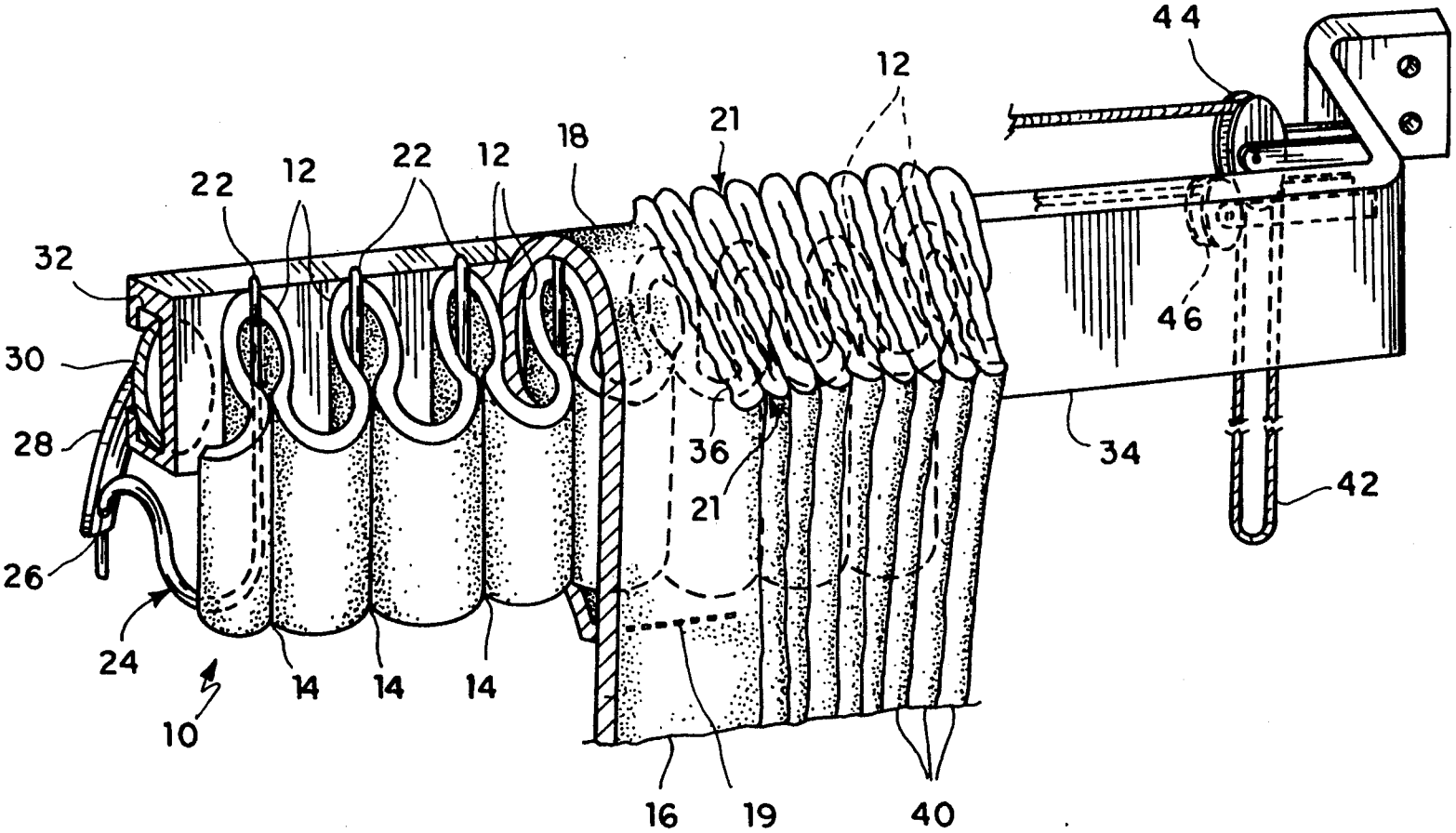
FIG. 4 is a front partial perspective view showing the pleats superimposed on the shirred drapes when opened.

In FIG. 2, a drape 16 is shown being gathered onto fabric strip 10 functioning as a supporting rod. Drape 16 has a rod pocket 18 sewn at the top of the drape 16 to receive fabric strip 10, as by stitching 19. As shown in FIG. 4, prongs 22 of drapery hooks 24 are pushed directly through the fabric of drape 16 to enter drapery hook pockets 12 at the rear of drape 16. Drapery hook 24 in turn is mounted through an opening 26 in a depending link 28 connected to a roller 30 which rides in a channel 32 formed in traverse rod 34. In FIG. 2, once drape 16 has been gathered on stiffened fabric strip 10, one end of rod pocket 18 is sewn to fabric strip 10 as by double stitching 48. Thereafter drape 16 is shifted to the right relative to fabric strip 10 to gather the material to create the shirred effect 36. By gathering drap 16 on the fabric strip 10 a continuous shirred effect is achieved as shown at 36, seen from the front of the drape when the drape is closed. Alternatively, pocket 18 may be stitched simultaneously as drape 16 is being pulled to the right and fabric strip 10 is being pulled to the left in FIG. 2, after the right end of rod pocket 18 has been sewn to the right end of fabric strip 10.

As shown in FIG. 3, once drape 16 has been gathered sufficiently on fabric strip 10, the left end of pocket 18 is attached to fabric strip 10 by another row of double stitching 48 to hold the shirred gathering in place. Thereafter, the drape is also attached to opposing drapery hook pockets 12, as indicated by stitching 38, to retain the relative positioning of drape 16 on fabric strip 10.

When opened, pleats 40 are superimposed on the shirred effect 36 of drapes 16 as shown in FIG. 4. If traverse rod 34 is used, as shown in FIG. 4, a drawstring 42 will serve to open and close drape 16 in a known manner. Drawstring 42 is passed over a pulley 44 which cooperates with a pulley 46 to guide drawstring 42. In addition, the top of drape 16 has been manually creased as at 21 between drapery hook pockets 12 as an aid to creating pleats 40. It should be noted that the invention is not limited to traverse rods, but may be used with any form of supporting rod, including a Deco' Rod (not shown).

Figure 5:
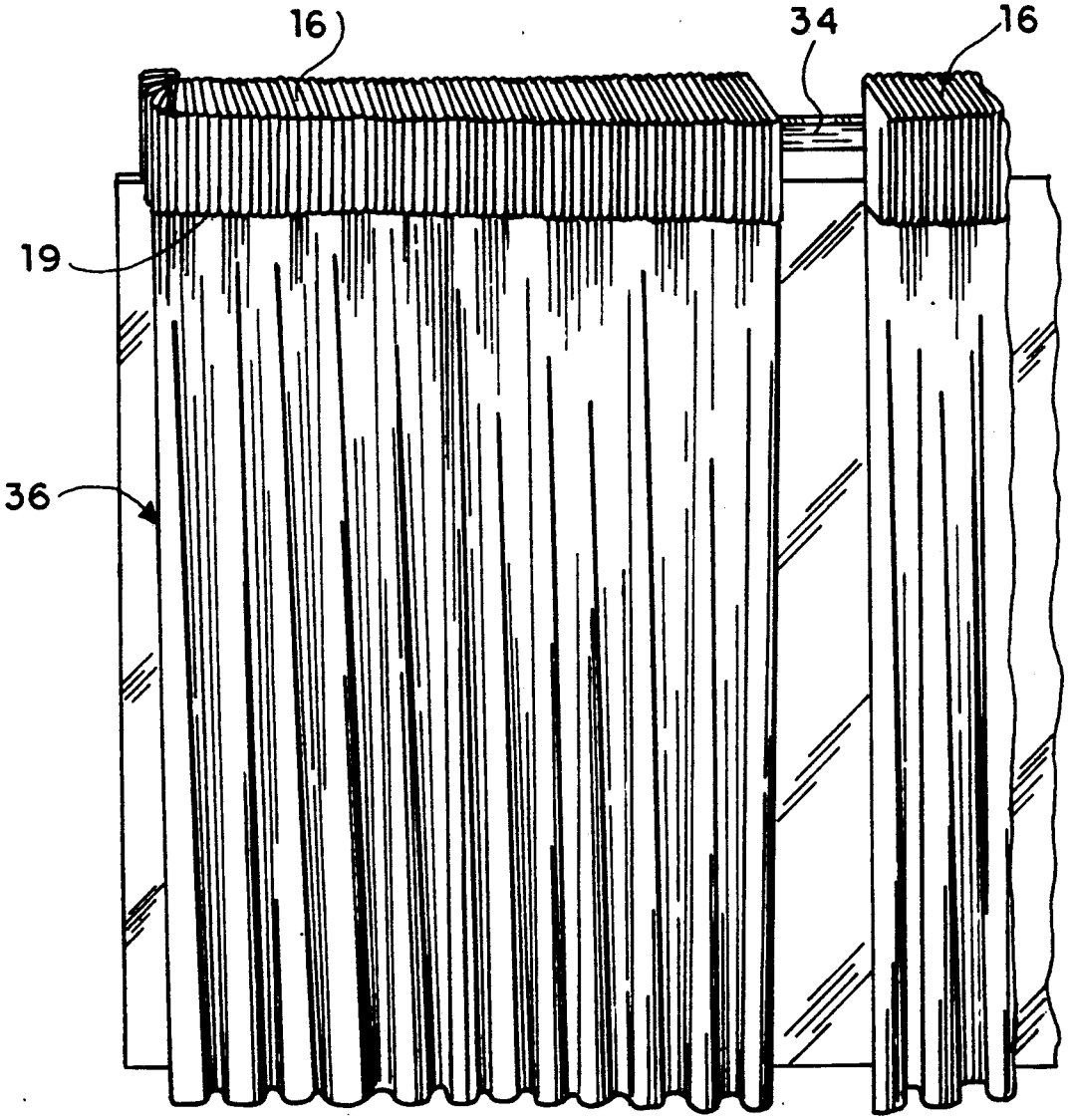
FIG. 5 is a front view showing the continuously shirred drape in a substantially closed position.

FIG. 5 shows drape 16 mounted on traverse rod 34 in a substantially closed condition, wherein pleats 40 are not visible, and the shirred effect 36 is shown to be continuous across the entire width of drape 16.

Each of the prior art arrangements disclosed in the patents cited above use unique specialty tapes and/or cords and/or hooks. This invention produces a new drape which uses standard drapery supplies, a new manufacturing method, and a new look for traversable drapes. While closed, the appearance is that of a shirred drape on a fixed rod. When opened, the appearance is that of a shirred and pleated drape on a rod. The readily available crinoline gives the drape the required stiffness to hold its shape while being opened and closed, and makes the drape durable enough to hold its shape after dry-cleaning.

This new manufacturing method saves labor, material and machine costs. It is contemplated that the crinoline would be pre-pocketed by a crinoline manufacturer, thereby saving additional drapery manufacturing time and associated costs. In any case, crinoline (pre-pocketed or not) is cheaper than specialty pleater tapes, hooks, and cords.

While it will be apparent that the preferred embodiment of the invention herein disclosed is well calculated to fulfill the objects above-stated, it will be appreciated that the invention is susceptible to modification, variations and change without departing from the proper scope or fair meaning of the subjoined claims.

We claim:

1. A shirred pleated drape comprising:

a stiffened fabric strip having pre-formed drapery hook pockets at even intervals therealong; and a drape having a rod pocket formed longitudinally along the top thereof, said rod pocket being of a size sufficient to insert said stiffened fabric strip therein;

said drape being gathered onto said stiffened fabric strip received in said rod pocket, thereby providing a shirred appearance across the width of the drape;

said drape being attached to said stiffened fabric strip at said drapery hook pockets and at each end of said rod pocket so as to retain said shirred appearance; whereby, when said shirred pleated drape is hung on a traversing rod said drape appears to be shirred across the entire width thereof when the drape is closed, and appears to have pleats superimposed thereon when the drape is opened.

2. A shirred pleated drape as in claim 1, wherein:

the stiffened fabric strip comprises crinoline.

3. A shirred pleated drape as in claim 2, wherein:

the pre-formed drapery hook pockets, the longitudinal rod pocket along the top, and the attachment of the drape to the stiffened fabric strip are provided by sewn stitches.

4. A shirred pleated drape as in claim 2, wherein:

the stiffened fabric strip is pre-cut to size.

5. A method of manufacturing a shirred pleated drape comprising the steps of:

providing a stiffened fabric strip with pre-formed drapery hook pockets evenly spaced across the length of said strip;

providing a drape with a longitudinal rod pocket along the top of said drape, said rod pocket being of a size to accommodate said stiffened fabric strip therein;

gathering said drape on said stiffened fabric strip received in said rod pocket as though said strip were a rod; and attaching said drape after gathering to said pre-formed drapery hook pockets and to each end of said stiffened fabric strip; whereby, when said shirred pleated drape is mounted on a traversing rod said drape has the appearance of a shirred drape across the entire width thereof when closed and the appearance of a pleated and shirred drape when opened.

6. A method of manufacturing a shirred pleated drape as in claim 5, wherein:

said stiffened fabric strip comprises crinoline.

7. A method of manufacturing a shirred pleated drape as in claim 5, wherein:

the stiffened fabric strip is precut to size.

8. A method of manufacturing a shirred pleated drape as in claim 5, wherein:

the pre-formed drapery hook pockets, the longitudinal rod pocket along the top, and the attachment of the drape to the pre-formed drapery hook pockets and to each end of the stiffened fabric strip are provided by sewn stitches.

* * * * *